United States Patent [19]

Porter

[11] 3,932,129

[45] Jan. 13, 1975

[54] SPACE DYED YARN PRODUCTION USING DENSE FOAMS

[76] Inventor: Rick Anthony Porter, 2826 Dunnington Circle, Atlanta, Ga. 30341

[22] Filed: July 17, 1974

[21] Appl. No.: 489,265

[52] U.S. Cl. ..... 8/176; 8/2
[51] Int. Cl.[2] ..... D06P 3/00
[58] Field of Search ..... 8/176, 2

[56] References Cited

UNITED STATES PATENTS

| | | | |
|---|---|---|---|
| 3,120,422 | 2/1964 | Weir | 8/14 |
| 3,484,179 | 12/1969 | Adams et al. | 8/2 |
| 3,724,997 | 4/1973 | von der Eltz et al. | 8/2 |

*Primary Examiner*—M. J. Welsh

[57] ABSTRACT

This invention relates to an effect coloration process for pseudo-random dyeing of yarns in package or skein form by force filling regions of the yarns with dye formulations immoblized in foam followed by microwave heating to accelerate the diffusion and reaction of the dyes.

2 Claims, 3 Drawing Figures

SPACE DYED YARN PRODUCTION USING DENSE FOAMS

Preliminary search revealed the following references:

| | | |
|---|---|---|
| 3,120,422 | Weir | Feb. 4, 1964 |
| 3,145,398 | Wyatt | Aug. 25, 1964 |
| 3,484,179 | Adams | Dec. 16, 1969 |
| 3,599,450 | Giesler | Aug. 17, 1970 |

OBJECTS OF THE INVENTION

The object of this invention is to produce simultaneous dyeing of multiple colors on yarns.

The process has advantages over conventional effect dyeing processes in that it is more versatile and requires minimal time, chemicals, and energy.

DESCRIPTIONS OF THE INVENTION

The process consists of forcing or injecting foamed dye or dye resist mixtures into different portions of a container in which a textile is packed or through a perforated tube on which a textile is wound. The textile may be a spun yarn, roving or a texturized continuous filament yarn. The textile may be composed of most natural or synthetic fibers or mixtures of these, e.g. cotton, wool, viscose rayon, acetate rayons, nylons, polyesters, acrylics, etc. Likewise, many classes of dyes appropriate for these fibers may be used e.g. acid, basic, disperse, reactive, and vat etc. The wide applicability of the process is due to the fact that the yarn container or package can be quickly and uniformly heated using microwave energy which accelerates the diffusion and reaction of the dyes. The use of microwave heating, which is usually prohibitively expensive, is made economical because the quantity of high heat capacity water is kept extremely small. The formulations used in this process are essentially the same as atmospheric pressure dyeing formulations for the given dye and fiber combinations with foaming components added and as much water as possible deleted.

In accordance with one aspect of this invention a polyester knitting yarn, which can be undyed or dyed with a solid base shade, is wound on a plastic tube using a winder in which the package is in contact with a drum which drives the package and traverses the yarn by way of a cam grove in the drum. This type of winder, commonly referred to as a drum type winder, produces in theory a package in which the length of yarn in the horizontal color zones indicated in FIG. 1 are equal. The package is placed on a stem through which foam may be directed to each of the color zones. The number of colors is limited in practice by the effective viscosity of the foam, the uniformity of the wind, and the height of the package. Typically the zones can be about one half inch in length.

A foam formulation for polyester consists of a foamer, foam stabilizer, carrier, disperse dye, propellant, and a quanity of water about equal to the total weight of the other components. Sufficient propellant is used to produce approximately a 20-fold increase in volume. The foam is allowed to penetrate about half way through the package before it is removed from the stem. The dense foam is light and immobile, thus preventing undesired color mixing even with somewhat abusive handling. Heating can be done by placing the package in a container then in a hot-air oven or steamer. However, the heating can most advantageously be done in a plastic container in a microwave oven in which, because of low water content, heating is uniform, rapid, and energy efficient. The package is heated from room temperature to near the boil during which time the foam continues to expand to more than fill the package. While not wishing to be bound there by, this expansion occures because the propellant comes out of solution in the carrier. It may be necessary on some color patterns to protect the outside of the package from excess foam run off. This can be done by wrapping the package with a perforated plastic film. The excess foam serves a beneficial purpose in that it keeps the outer yarns damp so that they dye uniformly.

The hot package is then stored for a short time in an insulated container, which may be the same container used in the microwave oven, until heat accelerated diffusion of the dye is complete. The package is then rinsed and dryed. Rinsing of the foam is easily performed, compared to the use of polymeric thickeners to immobilize the dyes. The rinse procedure must avoid excessive transfer of color from area to area. Due to the method of drum winding and zone filling of the package a pattern is produced which repeats in a fabric made from the yarn; however, due to minor variations in winding tensions and foam pressures, the zones are not perfectly formed and the repeat is not perfect. When made into a fabric this assures an average color uniformity throughout the fabric yet prevents unattractive pattern repeats.

The pattern may be modified by changing winding patterns, foaming patterns, or by injecting some portions of the package asymmetrically with a hollow needle through which foam is forced. These techniques produce a fabric which changes appearance throughout its length because the yarn is randomly dyed.

For all the advantages of foam there is one disadvantage; this is a strong tendency to channel, that is to seek a path of low fiber density. For this reason, winding must be carefully controlled.

In accordance with another aspect of this invention, skeins of nylon carpet yarn are packed in a perforated plastic bag which is then packed in a perforated container, as shown in FIG. 2. The bottom of the container is provided with foam nozzles which, on compressing the skeins to a density of one quarter to one half kilogram per liter, penetrate the bag. The foam is forced into the bag which is then heated, rinsed and dryed as before. For nylon the foam requires a greater portion of water to obtain satisfactory results because the nylon sorbs more water than polyester. The carrier is not required and acid dyes may be substituted for the disperse dyes. The pattern is obtained by folding of the skeins as they are placed in the bag so that different portions of each skein receives different color foams.

The foams for all of these processes are produced from a pressure vessel using liquified propellant gases such as hydrocarbons and halogenated hydrocarbons. Typically these must develop 5 to 20 atmosphers pressure at room temperature in order to produce sufficient pressure to force the foam through the fibers. Gases which can be used are dichlorodifluoromethane, monochlorodifluoromethane, methyl chloride, and propane. Mixtures of these gases with inert nitrogen, inert carbon dioxide, and air can be used to increase economy or reduce flammability. The foam formulation consists of a foamer such as a sodium or potassium salt of a fatty alcohol sulfate or an alkyl naphthalene sulfonic acid and a foam stabilizer which may be a fatty acid diethanolamine or acyl sarcosine adduct. The amount of each of these required depends on the foaming and defoaming characteristics of the dyes and dyeing assistants used. For example, with some highly emulsified commercially available polyester dye carriers, no foamer or stabilizer is required. The formulation containing a minimal amount of water is poured into a pressure vessel which is then closed and charged with sufficient liquid propellant to leave 5 to 40 grams of liquid propellant emulsified per liter of liquid. This amount of propellant is in addition to that which is vaporized to produce an equilibrium vapor pressure in the vessel.

DESCRIPTIONS OF THE DRAWINGS

The invention will be more fully described by reference to the accompanying drawings where in:

Figure 1:
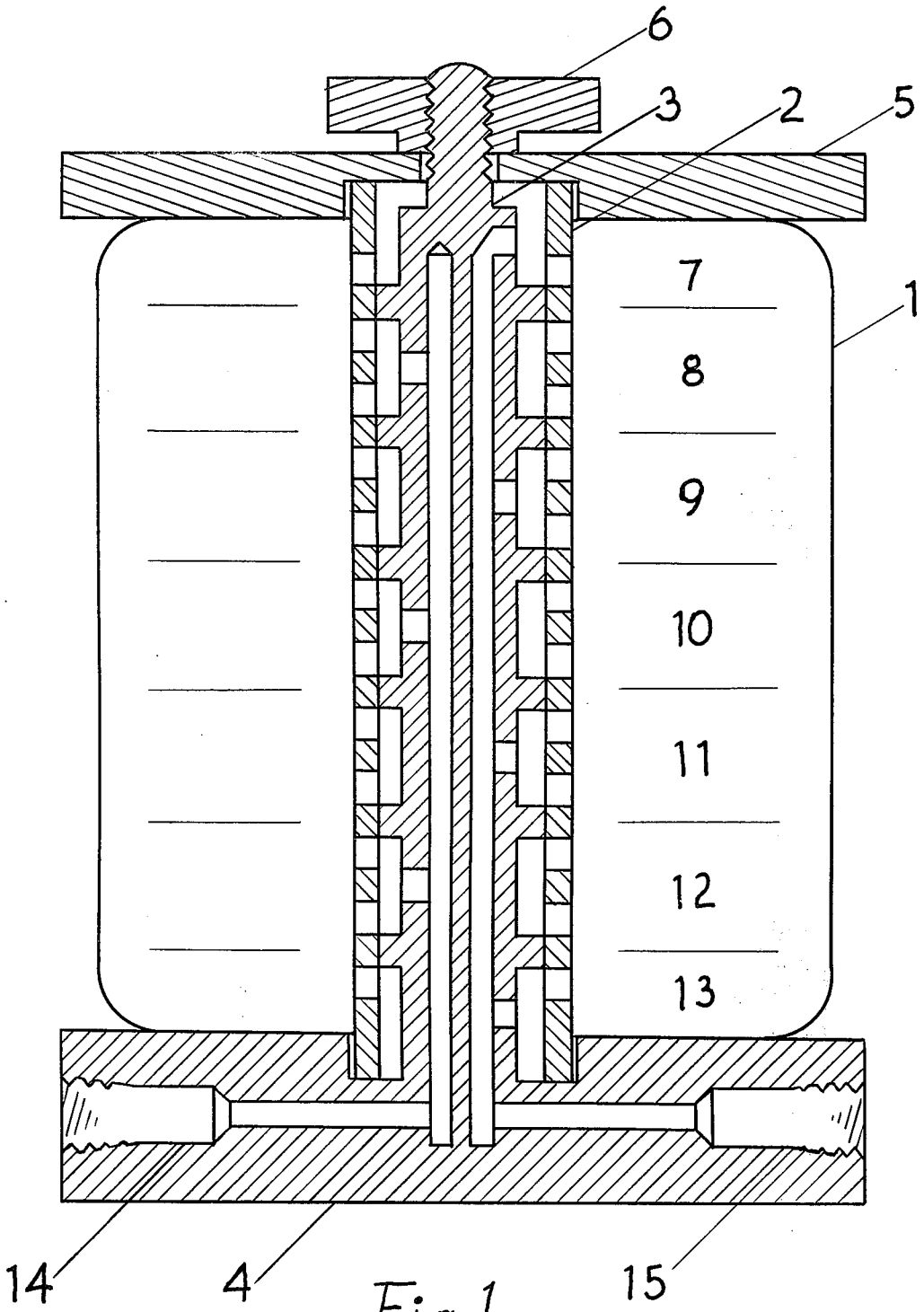
FIG. 1 is a sectional view of a two-color device for filling a yarn package with foam.

Referring more particularly to FIG. 1, there is shown the yarn 1 wound on a perforated tube 2 which is set on a stem 3 provided with a broad base plate 4. The package is topped with a plate 5, which along with the bottom plate, prevents foam flow through the ends of the package. The top plate is held down by a nut 6. This assures the foam will proceed radially in zones 7, 8, 9, 10, 11, 12, and 13 fed by the center portion of the stem. The stem is connected to the foam supplies at 14 and 15.

Figure 2:
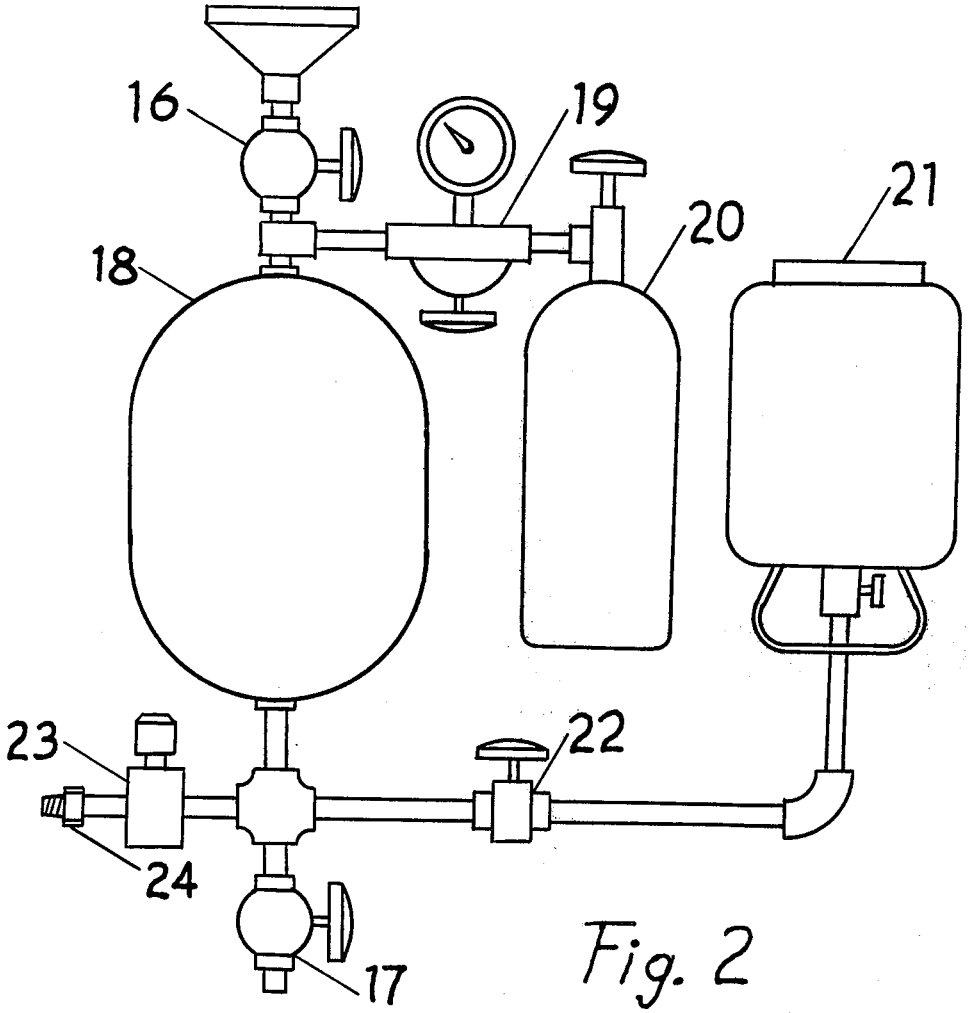
FIG. 2 is a diagram of a foam supply.

The foam supply, shown in FIG. 2, can be filled with dye formulation at valve 16 and drained at valve 17. The foam supply 18 can be brought to a controlled pressure using regulator 19 on inert gas container 20. Then a known amount of propellant from vessel 21 is added through the metering valve 22. Feed of the foam to the devices in FIG. 1 and FIG. 3 is controlled by electric valve 23 which connects to the devices at fitting 24.

Figure 3:
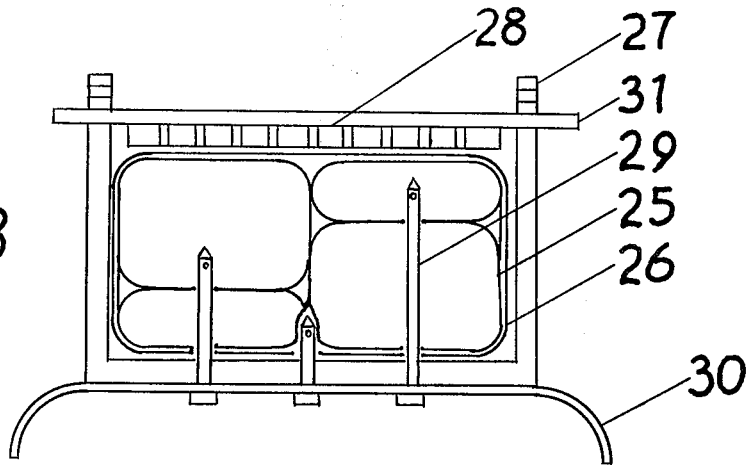
FIG. 3 is a sectional view of a device for filling skeins with foam.

In FIG. 3 folded skeins 25 are placed in a perforated bag 26 and then in an open-top box 27. A porous top 28 is used to compress the skeins until the pointed foam supply nozzels 29, mounted on a separate frame 30 from the box, penetrate the bag. The locking pins 31 are used to hold the skeins while they are filled with foam. The nonmetallic box is placed in a microwave oven to fix the dyes. Operation The following examples are given to illustrate the invention.

EXAMPLE I

The apparatus shown in FIG. 1 is used on a one pound package of undyed, 100 denier, texturized, continuous filament, polyethylene terephthalate, knitting yarn wound on a 6 and ⅝ inch polyvinylchloride dyeing tube using a drum winder to produce a package with density of 0.26 kilograms per liter. Two formulations are forced into the package simultaneously:

| | |
|---|---|
| 38% by weight | water |
| 30% by weight | sodium lauryl sarcosinate (foam stabilizer) |
| 20% by weight | sodium lauryl sulfate (foamer-emulsifier) |

-continued

| | |
|---|---|
| 5% by weight | meta-cresol (carrier) |
| 5% by weight | dye (see formulations below) |
| 2% by weight | sodium lignin sulfonate (dispersing agent) |

Formulation 1 dye used was Color Index disperse blue 27
Formulation 2 dye used was Color Index disperse red 4

The foam supply vessels, which have a volume of 2,100 cubic inches each, are depressurized and 15 kilograms of each formulation is added to their respective vessel. The vessels are pressurized to 100 p.s.i.g. with carbon dioxide and 1 pound of liquid propane is then metered into each vessel. The pressure is maintained at 115 p.s.i.g. with carbon dioxide while filling packages.

After a total of 180 grams of foam is added to a package, it is then placed in an isotatic polypropylene snap-lid container with a small hole in the lid. This is heated for 2 minutes in a 1600 watt microwave oven after which it is at 98°C. The container and package are then placed in a foamed polystyrene insulated box for 30 minutes after which the temperature falls to 82°C. The package is then removed and rinsed in cold water, then in warm water with 5 grams per liter of sodium hydroxide and sodium hydrosulfite, followed by a running rinse and drying.

When a large number of the yarns produced are knitted on a multiple feed weft knitting machine, regions are produced which vary in size from 1 square millimeter to 1 square centimeter, in shape from bars to spots, and in color from red to purple to blue.

EXAMPLE II

Using the apparatus shown in FIG. 3, two 48 inch skeins of undyed, 1,200 denier, polyhexamethylenediamine adipate, spun, carpet yarn, each 3 pounds in weight, are folded serpentine style three times and placed in a polyester bag then in a foamed polystyrene open-top box 12 by 14 inches and 8 inches deep. The skeins are compressed to 0.29 kilograms per liter and the foam is injected through 30 nozzels of unequal height. The foam formulations used are the same as in example I with the metacresol replaced with water.

The skeins containing 1200 grams of foam are heated for 9 minutes in a 1600 watt microwave oven, after which the yarn is at 97°C. The box, which is self-insulating, is stored for 15 minutes after which time the yarn is at 75°C. The skeins are then removed and rinsed as in EXAMPLE I.

When tufted into a carpet, regions are produced which vary in size from one tuft to 1 square centimeter, in shapes which are generally heathery, and in color from red to violet to blue and white.

Having described my invention, what I claim and wish to secure is:

1. The process which comprises forcing different colored foamed dye solutions or foamed dye resist solutions into yarn packages followed by microwave heating to accelerate the diffusion and reaction of the dyes in the fiber.

2. The process which comprises forcing different colored foamed dye solutions or foamed dye resist solutions into skeins followed by microwave heating to accelerate the diffusion and reaction of the dyes in the fiber.

* * * * *